US006460856B2

(12) United States Patent
Davies

(10) Patent No.: US 6,460,856 B2
(45) Date of Patent: Oct. 8, 2002

(54) BOARD GAME AND METHOD OF PLAYING

(76) Inventor: Haulwen Elizabeth Laye Davies, 12 Wykeham Terrace, Brighton BN1 3FF (GB)

( * ) Notice: Subject to any disclaimer, the term of this patent is extended or adjusted under 35 U.S.C. 154(b) by 0 days.

(21) Appl. No.: 09/933,660

(22) Filed: Aug. 22, 2001

(65) Prior Publication Data

US 2001/0054795 A1 Dec. 27, 2001

Related U.S. Application Data

(62) Division of application No. 09/431,211, filed on Nov. 1, 1999.

(51) Int. Cl.[7] ..... A63F 3/00
(52) U.S. Cl. ..... 273/275; 273/288
(58) Field of Search ..... 277/242, 258, 277/266, 267, 275, 288, 292

(56) References Cited

U.S. PATENT DOCUMENTS 1,973,564 A * 9/1934 Graham
2,162,876 A * 6/1939 Barton
3,643,956 A * 2/1972 Bovasso
4,180,271 A * 12/1979 McMurchie
4,215,866 A * 8/1980 Shimizu
4,466,615 A * 8/1984 Yaeger
5,692,749 A * 12/1997 Vogeler

FOREIGN PATENT DOCUMENTS

| | | |
|---|---|---|
| GB | 2014860 | 9/1979 |
| GB | 2214822 | 9/1989 |
| GB | 221654 | 2/1990 |
| GB | 2233912 A * | 1/1991 |

* cited by examiner

*Primary Examiner*—Benjamin H. Layno
*Assistant Examiner*—Vishu K Mendiratta
(74) *Attorney, Agent, or Firm*—Clark & Brody

(57) ABSTRACT

A method for playing a game with a playing area having an indicia representing first and second parallel spaced apart finish lines; a first and second sets of playing pieces. The first set comprises a plurality of first and second pieces, with the first pieces having indicia denoting two positions adjacent which further playing pieces may be placed. The indicia comprise a substantially unbroken path of a first color extending between the two positions, the remainder of the piece being a second color. The second playing pieces have three positions adjacent which further playing pieces may be placed and are of the same color scheme as the first playing pieces. The second set of pieces is the same as the first but with the colors transposed. As part of play, players take turns placing pieces on the playing board with each team attempts to build a winning path.

15 Claims, 3 Drawing Sheets

BOARD GAME AND METHOD OF PLAYING

This application is a divisional of U.S. Patent application No. 09/431,211, filed Nov. 1, 1999.

FIELD OF THE INVENTION

This invention relates to a game and apparatus therefor which conveniently is implemented as a board game but could, for example be a computer game.

BACKGROUND OF THE INVENTION

GB 2 221 654 describes a board game comprising a playing area and a single set of playing pieces defining paths.

GB 2 214 822 and GB 2 014 860 describe a board game comprising a playing area and two sets of playing pieces each defining paths.

U.S. Pat. No. 4,180,271 describes a board game comprising a playing area, a set of playing pieces defining paths and means to associate paths with particular players.

BRIEF SUMMARY OF THE INVENTION

According to the invention there is provided game apparatus comprising i. a playing area;

ii. a first set of playing pieces comprising a plurality of first and second playing pieces, the first playing pieces having indicia denoting two positions adjacent which a further playing piece may be placed, the indicia comprising a substantially unbroken path extending between the two positions and of a first colour or tone, substantially the remainder of the playing piece being of a second colour or tone, and second playing pieces having indicia denoting three positions adjacent which a further playing piece may be placed, the indicia comprising a substantially unbroken path extending between the three positions and of the first colour or tone, substantially the remainder of the playing piece being of the second colour or tone; and iii. a second set of playing pieces substantially the same as the first set of playing pieces but with the first and second colours or tones transposed.

The playing pieces may be square.

At least some of said first playing pieces may have indicia denoting adjacent edges of the playing piece.

At least some of said second playing pieces may have indicia denoting each edge of the playing piece.

The game may include at least some of said third playing pieces denoting only a single edge against which a playing piece may be placed.

The game may include at least one playing piece representing voiding of playing pieces directed or indirectly adjacent the playing pieces.

The game may include at least one playing piece having user defined indicia.

The same may include at least one playing piece having indicia representing a crossing of a first line of a set of playing pieces by a second line of a set of playing pieces.

The playing area may have indicia (5) representing a start position.

The playing area may have indicia representing scoring positions.

BRIEF DESCRIPTION OF THE DRAWINGS

The invention will be illustrated by way of non-limiting example by reference to the accompanying figures of which.

DETAILED DESCRIPTION OF THE INVENTION

In essence the players attempt to place one or more continuous strings of playing pieces defining a path across the board. Depending on the variant the winner may be the first to place a string or points may be awarded for the number or complexity of the strings.

Playing pieces can only be placed in accordance with the rules explained hereinafter.

Figure 1:
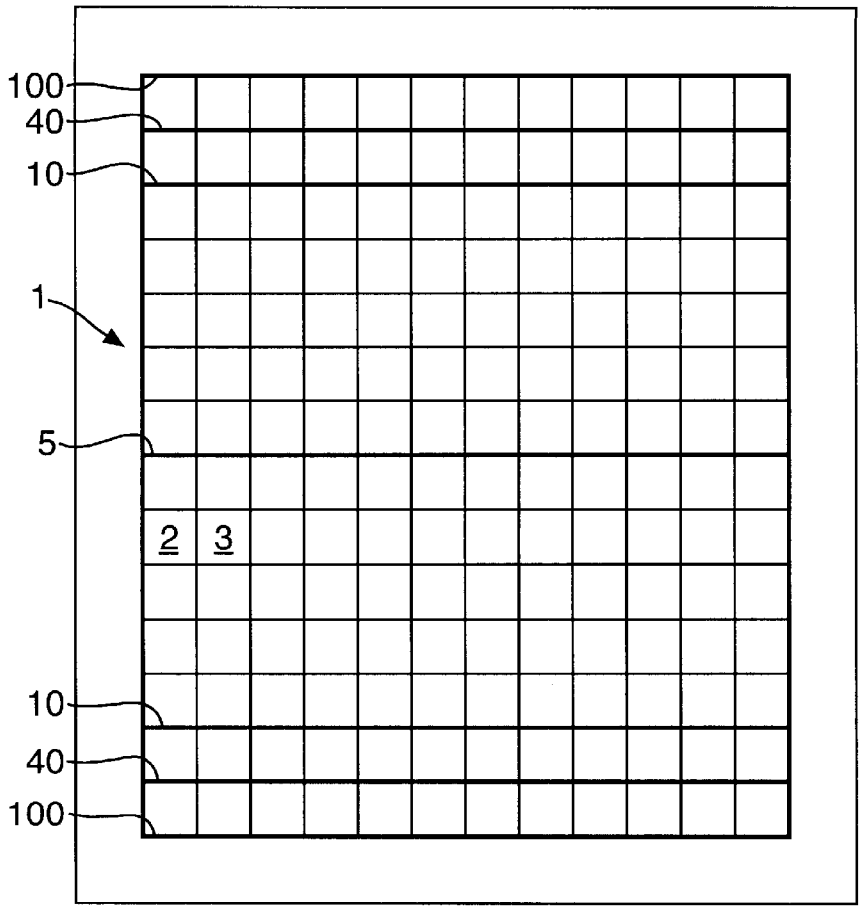
FIG. 1 is a plan view of a board.
Figure 2:
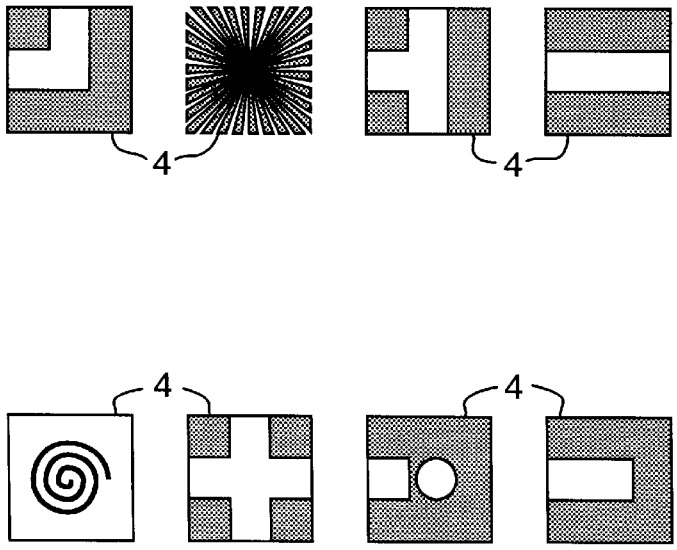
FIG. 2 is a plan view of a set of playing pieces.

As can be seen from FIG. 1 a playing area 1 is provided. Conveniently the playing area is marked with an array of playing positions 2, 3. In the illustrated embodiment the array of playing positions comprises a rectangular array of squares. This is not essential and it will be apparent to the skilled that other shaped arrays such as squares and hexagons can be employed.

In some embodiments of the invention scoring lines may be provided for scoring as described hereinafter. Thus in the illustrated embodiment there are first scoring lines 10, second scoring rows 40, and third scoring rows 100.

As will become apparent hereinafter the playing pieces 4 need not be square nor even four sided. It will however generally be preferred that the playing pieces are regular polygons. Four sides are preferred since with a much greater number of sides the game can become too complex. Similarly triangular pieces can lead to a game which is too simple.

Each playing piece 4 bears indicia. A first set of playing pieces having indicia of a first colour or tone representing a path on a background of a second colour or tone can be provided. A second set of playing pieces having indicia of the second colour or tone on a background of the first colour or tone can be provided.

The path may be about one third the width of the edge of the playing piece and may be positioned at about the centre of the edge. For example the path may comprise about 25% to about 50% of the width of the edge, preferably about 30% to about 40%. This means that first playing pieces appear to be negative versions of second playing pieces. This is desirable in that it provides an aesthetically pleasing pattern but more perhaps importantly In that this is helpful in developing visual perception and visual memory.

In preferred embodiments of the invention, players draw at random a predetermined number, for example 5, 6 or 7, of playing pieces from a mixed stock of first and second sets of playing pieces. The players are not obliged to disclose the pieces selected. As pieces are played they are replaced from the stock until it is exhausted. The precise range of indicia chosen depend on the variant of the game selected. As a bare minimum the playing pieces are selected from:

i. comers ii. tees

In embodiments using four or more sides it will generally be desirable to provide further playing pieces in the form of iii. straight lines iv. cross roads.

For example in the illustrated embodiment one set comprises a white path on a black background and another set comprises a black path on a white background. The invention is not so restricted and for example orange and blue would be acceptable colours and shades of grey acceptable tones.

In some embodiments of the invention further pieces may be provided. Examples include one or more of the following. A terminator piece may be provided. This piece can be placed adjacent to only one other piece. To continue to extend the line of playing pieces the line must therefore be branched. A 'poison' piece can be provided: this piece voids a line of pieces. A 'bridge' piece can be provided which allows lines to cross one another. A 'magic' piece which is defined by the player can be provided. That is to say the player can declare that the piece is deemed to be any of some or all of the other pieces.

Penalty points may be associated with some or all playing pieces as exemplified hereinafter.

Figure 3:
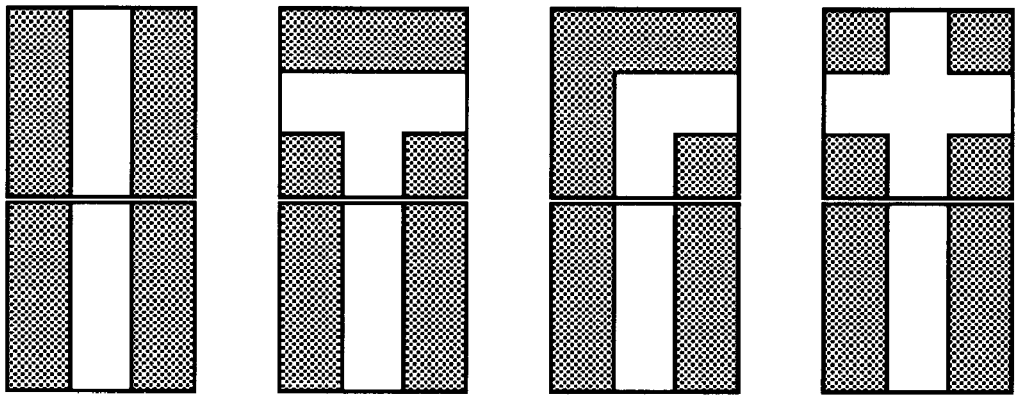
FIG. 3 shows a series of acceptable playing situations.
Figure 4:
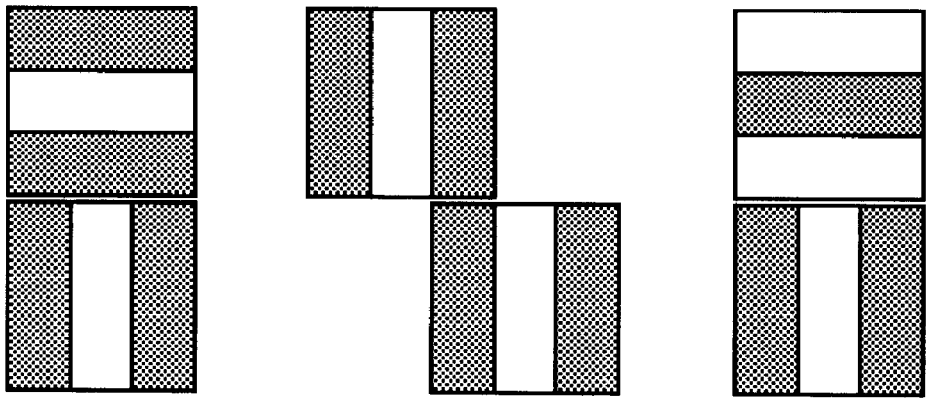
FIG. 4 shows a series of unacceptable playing situations.

A first player attempts to build a continuous path of the first colour or tone across the playing area while a second player attempts to build a continuous path of the second colour across the board. The players may, and generally will, hold pieces from both sets of playing pieces. They take it in turns to play. They may play either provided that the placed pieces form a continuous path. Thus FIG. 3 shows a series of acceptable playing situations and FIG. 4 a series of unacceptable playing situations. There may be multiple paths of either or both sets.

The first player may for example choose to play a piece to lengthen a path of the first colour. On the other hand he may choose to play a piece of the second colour to lengthen the path of the second colour. In this event he will generally attempt to make the second player's task more difficult by for example attempting to turn the path back on itself or to block it by leading it to the edge of the playing area. In some embodiments the players attempt to construct a path between the parallel spaced apart finishing lines. They may be required to start placing pieces at a starting position which may be equidistant from and parallel with the finishing lines.

In more complex versions of the game some or all of the additional pieces described may be present.

In some embodiments of the invention the game terminates when one or more player has no pieces or no playable pieces. In other embodiments of the invention the game terminates when a complete line extending between both finishing positions or a number of complete lines have been constructed.

In some embodiments scoring may be provided. When the game terminates players total the number of penalty points associated with each unplayed piece in their hands. For example ten penalty points may accrue to each dead end piece, forty points may accrue to each magic, ie user defined, piece or bridge piece and one hundred penalty points may accrue to each poison piece.

Figure 5A:
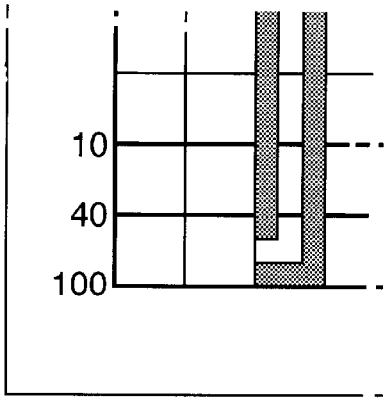
FIG. 5 shows some scoring configurations.
Figure 6:
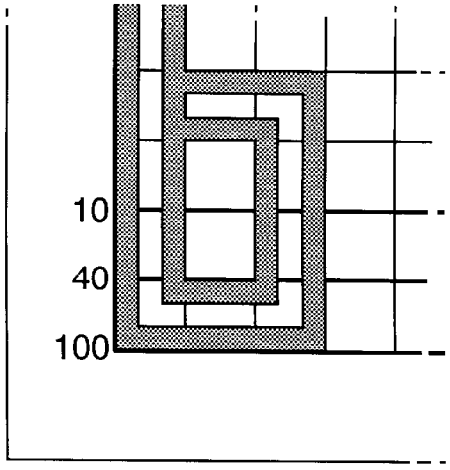
FIG. 6 shows some non scoring configurations.

Alternatively or additionally points may accrue for the paths built. In some embodiments the longest branch only of each path is used for scoring. All or some paths may be used for scoring. For example if only one path were constructed which passed from an end at the third scoring zone (100) at one end of the board to an end at a second scoring zone (40) at the other end of the board The score would be the sum of the points associated with the third zone, for example 100, plus the score associated with the second zone, for example 40. It should be borne in mind that the end of the path is not necessarily in the highest scoring zone since pieces may have been placed to extend the path from a higher scoring position to a lower or non scoring position as can be seen from FIG. 6. In the event the branch terminates in a dead end comer or T-piece this may be disregarded and the score calculated from the previous piece in the branch. It should be further borne in mind that to score the path colour and not merely the piece must abut the scoring zone. Thus the configuration in FIG. 5*a* scores only the score associated with a second scoring zone (40) since the tip of the path does not abut the third scoring zone (100).

Figure 5B:
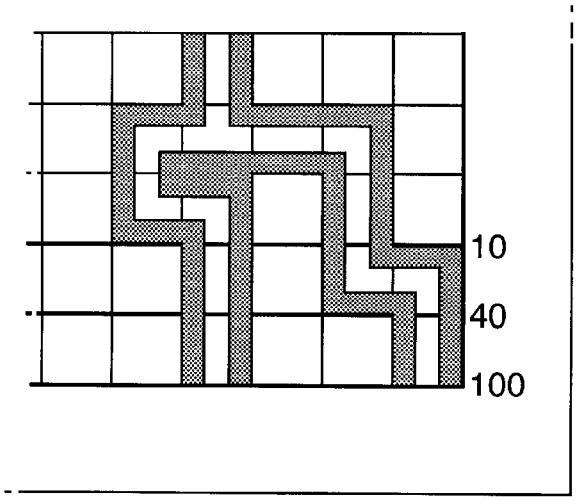

In some embodiments all branches of a path may be taken into account in scoring and thus for example the configuration of FIG. 5*b* scores twice the score associated with the third scoring zone (100). If 100 point were associated with a third scoring position the score would be 200.

Example embodiments are as follows:

EXAMPLE 1

A 12 wide by 14 long matrix board is provided. A start line 5 is provided half way along the length of the board. The winner is the first person to create a continuous line of pieces the length of the board. There are two players. Each set of pieces comprises fifteen straight paths sections, fifteen comers, six tees and six cross roads. One set of pieces comprises black tracks or paths on a white background and the other white tracks or paths on a black background.

The players decide for example by drawing lots who will play first. Each player draws at random seven pieces which are kept secret. The first player endeavours to create a continuous white path and the second player a continuous black path. The first player plays a piece by laying it on a square adjacent the start line which is provided along the middle of the playing area running parallel to a finish line. It may represent a black or white path. A replacement piece is drawn. The second player then plays a piece by laying it on a square adjacent the start line which is provided lo along the middle of the playing area running parallel to a finish line. It may represent a black or white path. A replacement piece is drawn. The first player then plays either by extending the path already in situ or provided opposing squares lying on the start line are vacant by starting a new line. He then draws a replacement piece. The second player plays a further piece in the same way as the first player. Play continues in this way until either one player's path reaches both finish ends of the playing area in which case that player wins or until one player can not play a piece in which case the longest path wins.

EXAMPLE 2

Example 1 is repeated except that four players compete in teams of two. Each player has five pieces.

EXAMPLE 3

Example 1 or Example 3 are repeated with the addition to each set of six terminator pieces and a total of four bridge pieces.

EXAMPLE 4

Example 1, 2 or 3 are repeated. The first path across the board does not however terminate the game. Once one player can no longer play the players scores are totalled. A scoring piece is either the last piece in a branch if this is on a scoring zone (7, 8) or the one before if the last piece is not a scoring piece. Total scores are added at each end. A continuous path from one end to the other gains a bonus for example of 300 points.

EXAMPLE 5

Example 4 is repeated with one 'poison' piece per set and a total of four 'magic' pieces.

EXAMPLE 6

Example 5 is repeated but penalty points for example 10 for each terminator, 40 for each magic or bridge and 100 for each poison piece are subtracted from the players score.

It may be desirable in all example to provide a time limit on the time each player may take to move and thus some embodiments of the invention provide a timer.

What is claimed is:

1. A method for playing a game comprising the steps of:

i) providing a playing area having indicia representing parallel first and second finish lines;

ii) providing a first set of playing pieces comprising a plurality of first and second playing pieces, the first playing pieces having indicia denoting two positions adjacent which a further playing piece may be placed, the indicia comprising a substantially unbroken path extending between the two positions and of a first color or tone, substantially the remainder of the first playing pieces being of a second color or tone, and second playing pieces having indicia denoting three positions adjacent which a further playing piece may be placed, the indicia comprising a substantially unbroken path extending between three positions and of the first color or tone, substantially the remainder of the second playing pieces being of the second color or tone;

iii) providing a second set of playing pieces substantially the same as the first set of playing pieces but with the first and second colors or tones transposed;

iv) associating the first set of playing pieces with a first player or team of players and associating the second set of playing pieces with a second player or team of players;

v) each player or team of players drawing randomly a predetermined number of playing pieces from a mixed stock of first and second sets of playing pieces; and vi) players or teams of players taking alternate turns to place pieces on the playing area, the first player or team of players attempting to build at least one continuous string defining a path from the first set of pieces across the playing area to the first finish line and the second player or team of players attempting to build at least one continuous string defining a path from the second set of playing pieces across the playing area to the second finish line.

2. The method of claim 1, wherein the playing pieces are square.

3. The method of claim 1, wherein at least some of the first playing pieces have indicia denoting adjacent edges of the playing piece.

4. The method of claim 1, wherein at least some of the second playing pieces have indicia denoting adjacent edges of the playing piece.

5. The method of claim 1, further comprising the step of providing third playing pieces, each third playing piece having indicia comprising a path of a first or second color or tone extending from the center of the face of the playing piece to an edge, substantially the remainder of the piece being of a second or first color or tone.

6. The method of claim 1, further comprising providing at least one fourth playing piece representing voiding of playing pieces directly or indirectly adjacent the fourth playing piece.

7. The method of claim 1, further comprising the step of providing at least one fifth, user defined, playing piece.

8. The method of claim 1, wherein the further step of providing at least one playing piece having indicia representing a crossing of a line of a set of first playing pieces by a second line of a set of second playing pieces.

9. The method of claim 1, comprising the further step of providing the playing area with indicia representing a starting line parallel with and equally spaced from the finishing lines.

10. The method of claim 1, wherein the width of the path of a playing piece is about 25 to 50% of the width of the edge of the playing piece.

11. The method of claim 1, wherein the game is ended upon fulfillment of either:

a) a player or one of the teams constructing a single predetermined number of continuous paths across the playing area; or b) a player or both players or one or both of the teams of players having no pieces or no playable pieces.

12. The method of claim 1, wherein the playing area is provided with indicia representing a pair of first scoring zones, a pair of second scoring zones, and a pair of third scoring zones, each scoring zone being parallel with a finishing line.

13. The method of claim 12, wherein the game is ended upon fulfillment of one of:

a) a player or one of the teams constructing a single predetermined number of continuous paths across the playing area;

b) a player or both players or one or both of the teams of players having no pieces or no playable pieces; or c) a player or one of the teams scoring a predetermined number of points.

14. The method of claim 1, wherein the parallel first and second finishing lines are separated by a single playing area, and the attempted path building of each player or team by placing pieces traversing the single playing area.

15. A board game comprising:

i) a playing area;

ii) a first set of playing pieces comprising a plurality of first and second playing pieces, the first playing pieces having indicia denoting two positions adjacent which a further playing piece may be placed, the indicia comprising a substantially unbroken path extending between the two positions and of a first color or tone, substantially the remainder of the first playing pieces being of a second color or tone, and second playing pieces having indicia denoting three positions adjacent which a further playing piece may be placed, the indicia comprising a substantially unbroken path extending between three positions and of the first color or tone, substantially the remainder of the second playing pieces being of the second color or tone;

iii) a second set of playing pieces substantially the same as the first set of playing pieces but with the first and second colors or tones transposed; and iv) at least one third, user defined, playing piece.

* * * * *